US010316399B2

(12) United States Patent
Langevin et al.

(10) Patent No.: US 10,316,399 B2
(45) Date of Patent: Jun. 11, 2019

(54) PRE-COOLING SYSTEM HAVING CONTROLLED INTERNAL ADJUSTMENT

(71) Applicant: Cockerill Maintenance & Ingéniérie S.A., Seraing (BE)

(72) Inventors: Stéphane Langevin, Ponthierry (FR); Michel Dubois, Boncelles (BE)

(73) Assignee: Cockerill Maintenance & Ingéniérie S.A., Seraing (BE)

( * ) Notice: Subject to any disclaimer, the term of this patent is extended or adjusted under 35 U.S.C. 154(b) by 503 days.

(21) Appl. No.: 14/926,950

(22) Filed: Oct. 29, 2015

(65) Prior Publication Data

US 2016/0047027 A1 Feb. 18, 2016
US 2018/0105917 A9 Apr. 19, 2018

Related U.S. Application Data

(63) Continuation of application No. PCT/EP2014/056523, filed on Apr. 1, 2014.
(Continued)

(30) Foreign Application Priority Data

Jul. 16, 2013 (EP) ..... 13176682

(51) Int. Cl.
*C23C 2/28* (2006.01)
*C21D 9/573* (2006.01)
(Continued)

(52) U.S. Cl.
CPC ..... *C23C 2/28* (2013.01); *C21D 1/667* (2013.01); *C21D 9/573* (2013.01); *C23C 2/003* (2013.01); *C23C 2/40* (2013.01); *F27D 15/0206* (2013.01); *C21D 1/613* (2013.01); *F27D 2009/0008* (2013.01); *F27D 2009/0075* (2013.01)

(58) Field of Classification Search
CPC .. C23C 2/28; C23C 2/003; C23C 2/40; C21D 1/667; C21D 9/573; C21D 1/613; F27D 15/0206
See application file for complete search history.

(56) References Cited

U.S. PATENT DOCUMENTS 6,309,483 B1 10/2001 Wang et al.
2001/0000377 A1 4/2001 Matsuda et al.
(Continued)

FOREIGN PATENT DOCUMENTS

JP 03291329 12/1991
JP 03291329 A * 12/1991

*Primary Examiner* — Jon T. Schermerhorn, Jr.
(74) *Attorney, Agent, or Firm* — Reinhart Boerner Van Deuren P.C.

(57) ABSTRACT

The invention relates to equipment for cooling a metal strip (2) having a liquid coating to be solidified, wherein said strip is continuously moving. Said equipment is characterized in that each half-cooler (11, 12) is divided, over the length thereof, into at least two sections, a first section (13) and a second section (14), in the direction of the movement of the strip (2). The first section (13) is separated from the second section (14) in each half-cooler (11, 12) by a respective internal adjustment device (7, 8), making it possible to change the gas flow/pressure parameter so that the value of said gas flow/pressure parameter is different in the first section (13) from the value of said parameter in the second section (14).

14 Claims, 4 Drawing Sheets

Related U.S. Application Data

(60) Provisional application No. 61/817,113, filed on Apr. 29, 2013.

(51) Int. Cl.

| | |
|---|---|
| ***C21D 1/667*** | (2006.01) |
| ***C23C 2/40*** | (2006.01) |
| ***F27D 15/02*** | (2006.01) |
| ***C23C 2/00*** | (2006.01) |
| *F27D 9/00* | (2006.01) |
| *C21D 1/613* | (2006.01) |

(56) References Cited

U.S. PATENT DOCUMENTS

| | | | | |
|---|---|---|---|---|
| 2002/0124916 | A1 | 9/2002 | Pasquinet et al. | |
| 2009/0315228 | A1* | 12/2009 | Pasquinet ..... | C21D 1/767 266/44 |
| 2010/0200126 | A1 | 8/2010 | Onozawa et al. | |
| 2011/0018178 | A1 | 1/2011 | Muller et al. | |
| 2011/0030820 | A1 | 2/2011 | Langevin et al. | |

* cited by examiner

PRE-COOLING SYSTEM HAVING CONTROLLED INTERNAL ADJUSTMENT

CROSS-REFERENCE TO RELATED APPLICATIONS

This patent application is a continuation of PCT Application No. PCT/EP2014/056523, filed Apr. 1, 2014, which claims priority to U.S. Provisional Application No. 61/817,113, filed Apr. 29, 2013 and European Application No. 13176682.6 filed, Jul. 16, 2013, the entire teachings and disclosure of which are incorporated herein by reference thereto.

SUBJECT-MATTER OF THE INVENTION

The present invention relates to a new device in the field of pre-cooling boxes using a gaseous fluid atmosphere (air, nitrogen, etc.), called "pre-coolers", used for example in cooling towers for hot metal coating lines, in particular of the Aluzinc (such as Galvalume®, Al—Zn alloy, made up of 55% aluminum) and aluminized type, but also galvanized (zinc-plated) coating.

In particular, this device applies to all cooling boxes blowing a gas over a continuously moving metal strip and having a liquid and unset coating having just been applied thereon.

TECHNOLOGICAL BACKGROUND AND STATE OF THE ARTS

It is known that coatings of the Aluzinc, aluminized or other type of the same genre having just been applied on a continuously moving metal strip must be solidified quickly to avoid intermetallic growth and obtain a correct microstructure in order to obtain a good corrosion resistance.

To solidify these coatings, pre-cooling units called "pre-coolers" or cooling units called "air cooling boxes or air coolers or ducts" are used, made using technologies and constructions of slots, nozzles or holes.

To simplify matters, reference will be made only to "coolers" hereafter. A series of coolers is typically installed above equipment for applying the coating up to the first return roller of the cooling tower.

The first cooling device(s) is (are) usually movable so as to provide the space necessary in order to maintain that equipment for applying the coating. These first cooler(s) generally use slot technology.

Each cooler is generally equipped with a fan operating with a variable speed motor, so as to be able to adjust its flow rate and cooling air pressure based on the strips and coatings to be treated.

If the impact of the cooling gas is too great when the coating has not yet set, a wavy layer or marks or lines may form, and the obtained final product may thus not comply with market quality requirements. The sensitivity of the liquid layer to these flaws essentially depends on the viscosity and the thickness of the liquid layer as well as the impact of the gas.

In the context of modifying the galvanization line and increasing production capacity, and therefore cooling, given that the heights of the towers are difficult to alter, a same poor quality phenomenon may be observed due to excessively intense cooling on a coating that has not yet solidified and usually in a certain temperature range.

Document US 2010/0200126 discloses equipment for producing, by hot dipping, galvanized/annealed steel sheets under optimal production conditions at any time despite rapid changes in the type of steel, coating and other outside factors. The unit for producing galvanized/annealed steel sheets by hot dipping is provided with a maintaining/cooling furnace for treating steel sheets having left a rapid heating furnace. Furthermore, the maintaining/cooling furnace is configured to allow a change of the ratio in the furnace of the maintaining zone to dip the steel sheet using dipping means at a maintaining temperature of 500 to 650° C. and of the cooling zone to cool the steel sheet using spray nozzles at an average cooling speed of 5° C./second or more.

Document US 2001/0000377 discloses a method and system for cooling a steel strip. A high water volume mist cooler and a low water volume mist cooler are positioned successively along the direction in which the steel strip moves. The high water volume mist cooler vaporizes a high water volume mist on the surface of the steel strip to cool the latter, and then the low water volume mist cooler vaporizes a low water volume mist on the surface of the steel strip to cool the later, thus cooling the steel strip while eliminating the influence of the transitional boiling, in order to prevent the steel strip from having a non-uniform temperature portion.

Document US 2011/0018178 discloses a method for acting on the temperature of a moving strip by blowing a gas or a water/gas mixture, in which a plurality of gas or water/gas mixture jets, extending toward the surface of the strip and arranged such that the impacts of the gas or water/gas mixture jets on each surface of the strip are distributed at the nodes of a two-dimensional network, are sprayed on each face of the strip. The impacts of the jets on one face are not across from the impacts of the jets on the other face, and the jets of gas or water/gas mixture come from tubular nozzles that are supplied by at least one distribution chamber and extend at a certain distance from the distribution chamber so as to leave a space free for the return flow of the gas or the water/gas mixture that is parallel to the longitudinal direction of the strip and perpendicular to the longitudinal direction of the strip.

Document US 2011/0030820 discloses a device for blowing gas on the face of a material in a moving strip, including at least one hollow box whereof one wall, turned toward the relevant face of the strip material, is equipped with a plurality of blowing orifices, making it possible to direct gas towards the face of the strip material. The hollow box is further laterally equipped, at least on one side thereof in reference to a median plane perpendicular to the plane of the strip, with a movable closing member serving to selectively close off some of the blowing orifices in order to adapt the width of the blowing zone to the width of the strip material in question.

Technical Problem

The problem to be resolved is as follows (see FIG. 1). The unset coating of the strip 2 must be cooled and solidified by the two air half-coolers 11 and 12, making up the cooler 1. The half-coolers 11, 12 are connected to a supply circuit 3 supplied with air by a fan 4 actuated by a motor 5.

The cooling atmosphere flow rate is regulated by a speed variator 6 of the motor 5 of the fan 4 in order to cool the strip, and thus its coating, more or less quickly depending on the desired quality. It will be noted that, subsequently, the term "flow rate/pressure parameter" will be used because the change in the fan rating modifies both the flow rate and the pressure of the gas, the two being related.

On the one hand, in the first part of the cooler, the speed and the flow rate of the cooling air must be limited given that the coating is still completely in the liquid phase, failing which a wavy layer and/or a layer with an appearance and a microstructure not in compliance with quality standards may be obtained.

On the other hand, on certain strip formats and coating thickness formats, the cooling must be significant in order to avoid intermetallic growth and obtain a correct microstructure.

The two preceding points are therefore sometimes incompatible, given that the cooling air flow rate is sent more or less uniformly, in the current technique, over the entire height of the two air half-ducts 11, 12.

AIMS OF THE INVENTION

The present invention aims to eliminate the drawbacks of the state of the art.

In particular, the invention aims to adjust the cooling gas flow rate/pressure parameter, for example in the (pre-) cooling boxes or in upper coolers situated at the outlet of units for applying liquid coating, depending on the types of metal strips and coatings to be handled, in order to prevent flaws from forming in the coating.

Also in particular, the invention aims to divide a single cooler into several sections in order to obtain several flow rate/pressure ratings over the entire height of the cooler, and preferably with a single fan.

MAIN FEATURES OF THE INVENTION

The present invention relates to equipment for cooling a metal strip having a liquid coating to be solidified, said metal strip being continuously moving, said equipment including a cooling box provided with two gas half-coolers, preferably using air, each designed to cool one face of the strip and having, on its inner face across from the respective face of the strip, a plurality of nozzles or slots for injecting the gas at a certain flow rate, each half-cooler being divided over its length into at least two sections, a first section and a second section, successively arranged in the direction of the movement of the strip, the first section being separated from the second section in each half-cooler, transversally relative to the movement of the strip, by an internal regulating device able to modify the flow rate/pressure parameter in the first and second respective segments, the equipment being characterized in that the internal regulating devices:

- either are diffusers comprising two superimposed plates each having a plurality of holes or slots and whereof the movement of one relative to the other results in modifying the opening section of the diffusers;
- or comprise a single rotary flap or a plurality of rotary flaps;
- or comprise an adjustable moving plate of the guillotine type.

According to preferred embodiments of the invention, the equipment will be limited by one or a suitable combination of the following features:

- the internal regulating devices are actuated by pneumatic or electromechanical actuators;
- the half-coolers are connected to a shared supply circuit, supplied with gas by a fan, which in turn is actuated by a motor;
- the supply circuit shared by the two half-coolers is connected to the second section of at least one of the two half-coolers or to the section with a higher flow rate or higher pressure of gas;
- the motor is provided with a speed variator making it possible to regulate the cooling gas flow rate/pressure parameter;
- the equipment comprises means for jointly or individually actuating the internal regulating devices as a function of the gas flow rate/pressure parameter regulated by the speed variator and the desired coating quality;
- the actuators of the internal regulating devices are remotely controlled by a line operator;
- the internal regulating devices are duplicated, thereby creating a third section, intermediate between the first inlet section of the strip and the second outlet section of the strip, in order to obtain different gas blowing speeds in the aforementioned three sections;
- the equipment is provided to move the strip in a vertical strand;
- the equipment includes a pyrometer installed just after the internal regulating devices in the direction of the movement of the strip, to monitor the solidification of the coating.

A second aspect of the present invention relates to a method for cooling a metal strip moving continuously and having a liquid coating to be solidified, using the aforementioned equipment, comprising a step for modifying the flow rate/pressure parameter of gas injected by means of internal regulating devices such that the value of said injected gas flow rate/pressure parameter is different in the first section relative to its value in the second section.

Advantageously, the injected gas flow rate/pressure parameter is modified such that the value of said injected gas flow rate/pressure parameter is lower in the first section compared to its value in the second section.

Still advantageously, the gas flow rate injected in the first section of the cooling equipment, called primary flow rate, is regulated to control the solidifying front and solidification speed of the coating that is still in liquid phase at the inlet of the first section.

Also advantageously, the injected gas flow rate in the second section of the cooling equipment, called secondary flow rate, is regulated to be higher than the primary flow rate and compatible with predetermined cooling slopes.

DESCRIPTION OF PREFERRED EMBODIMENTS OF THE INVENTION

Figure 1:
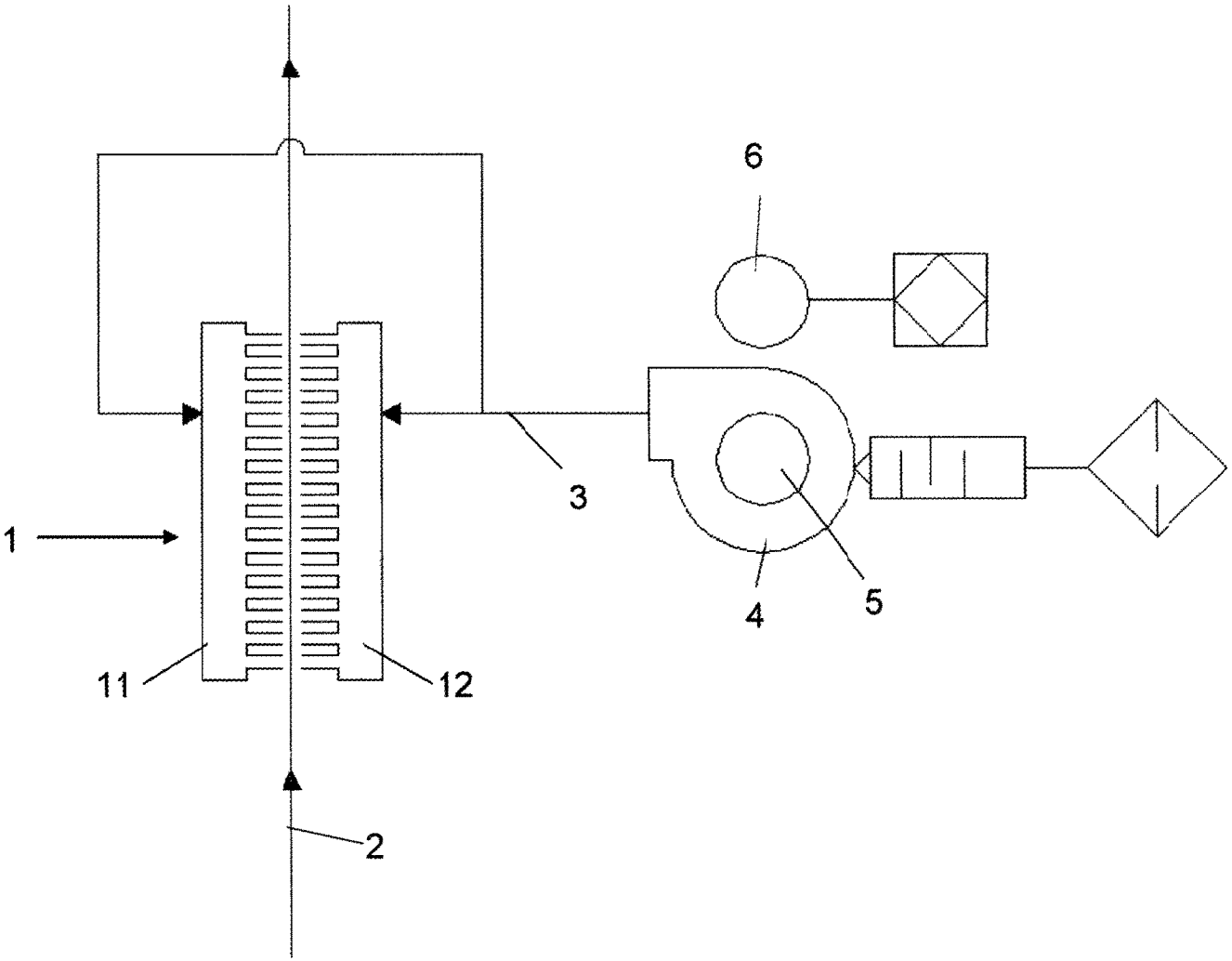
FIG. 1 diagrammatically shows a cooler according to the state of the art.
Figure 2:
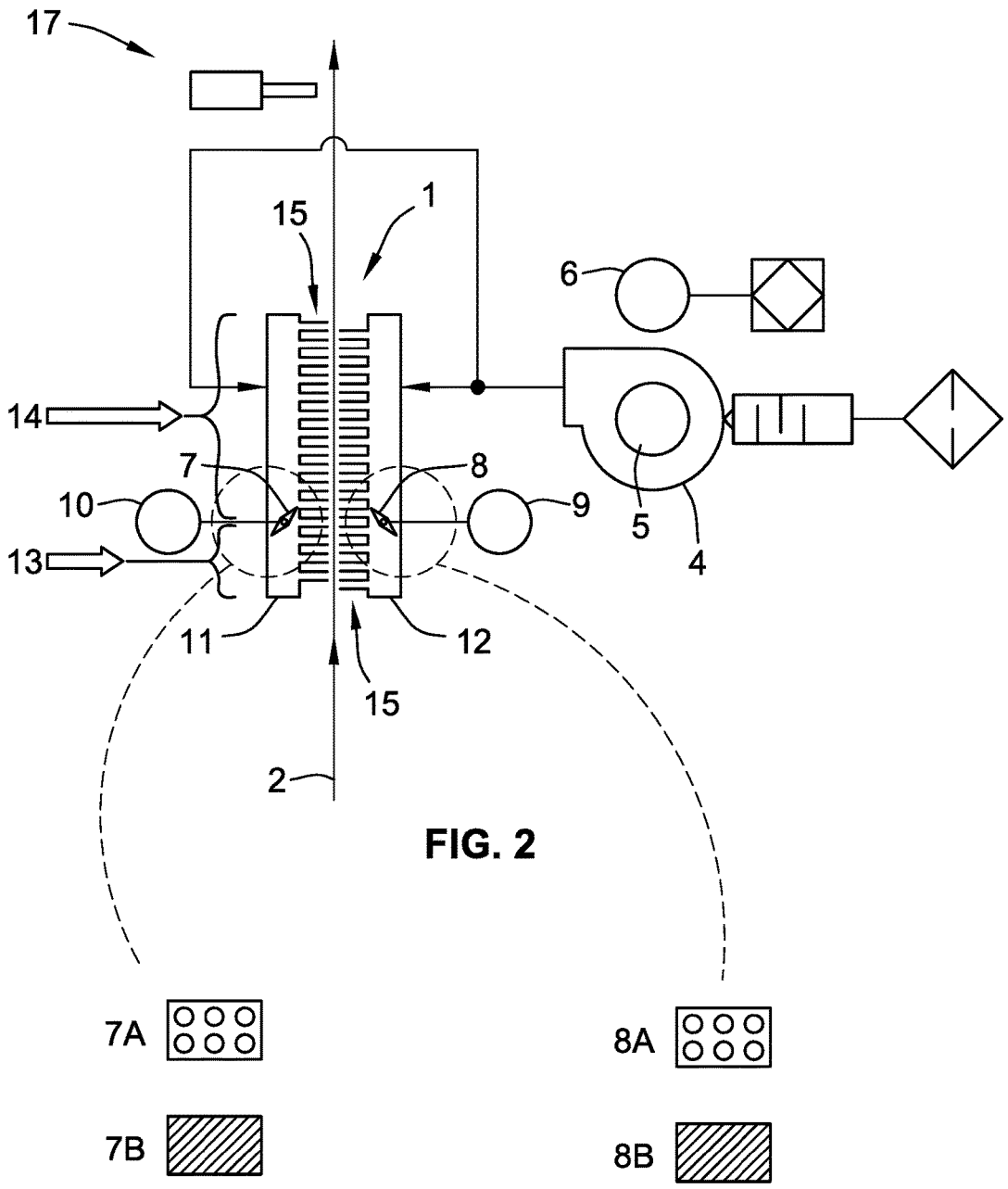
FIG. 2 diagrammatically shows a cooler according to the present invention, equipped with adjustable internal flow rate equipment remotely controlled.

The present invention provides a solution to the technical problem set out above (see FIG. 2). According to the invention, internal regulating systems or equipment 7, 8 are respectively installed in the two air half-coolers 11, 12. These regulating systems 7, 8 are intended to modify and adjust the cooling fluid flow rate between the lower parts (inlet of the cooler) and the upper parts (middle and outlet of the cooler) while maintaining a uniform flow rate per unit of surface for each section. The care taken in producing the equipment to avoid disrupting the flow of the gas is very important in order to have homogenous and regular cooling of the coating to be solidified.

According to one particular embodiment, these separating systems 7, 8 may be duplicated if necessary in order to obtain different blowing speeds between the inlet, the middle and the outlet of the cooler, respectively.

These regulating systems 7, 8 are advantageously actuated by pneumatic or electromechanical actuators 9, 10, with the possibility of being remotely controlled by the line operator. These regulating systems 7, 8 are preferably actuated jointly as a function of the air flow rate regulated by the variator 6 of the motor 5 of the fan 4 and the obtained coating quality.

Figure 3:
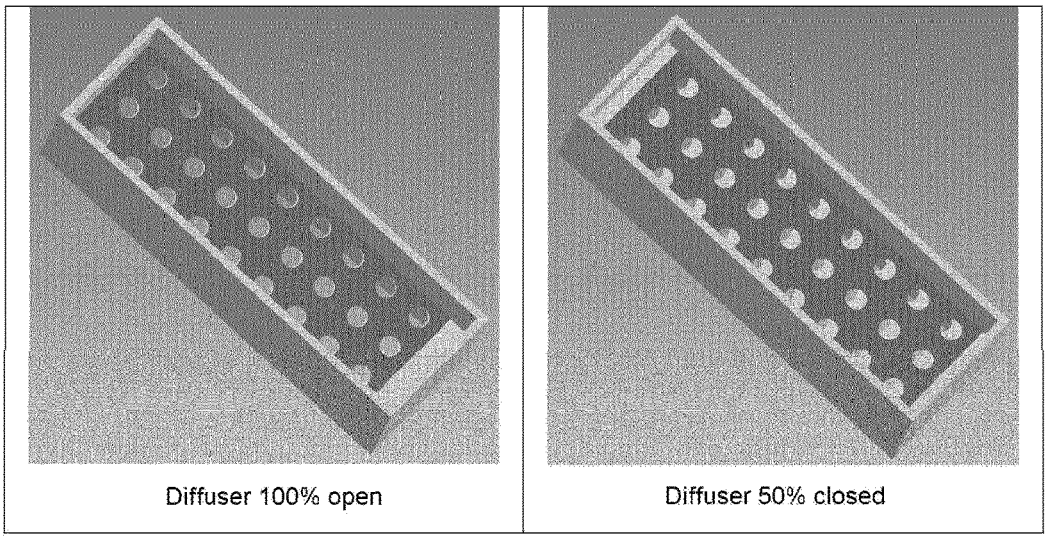
FIG. 3 shows a first embodiment of the regulating system according to the invention, in the form of a diffuser.
Figure 4:
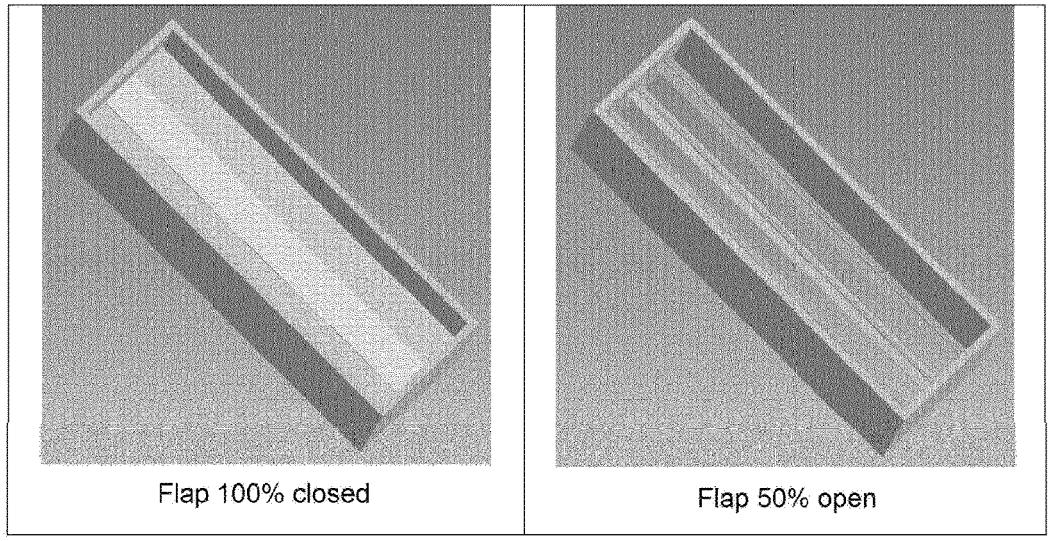
FIG. 4 shows a second embodiment of the regulating system according to the invention, in the form of a flap.
Figure 5:
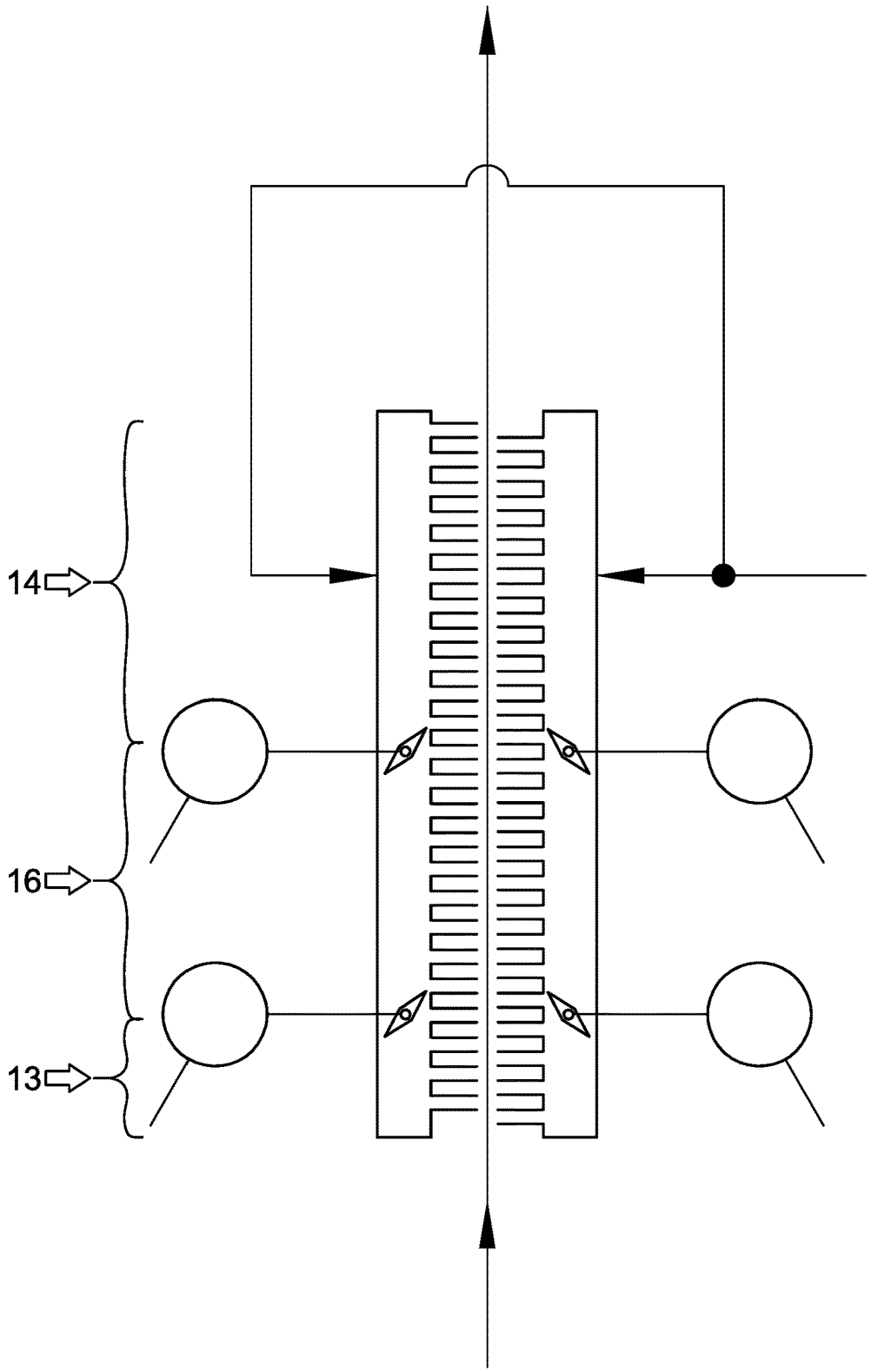
FIG. 5 shows a half cooler having a third section.

According to preferred embodiments, these regulating systems 7, 8 can include:

diffusers 7A, 8A comprising two superimposed plates, both having a series of holes or slots. The movement of one of the plates relative to the other results in decreasing the opening section and therefore acts as a homogenous adjustable "diffuser" with respect to the cooling air (see FIG. 3),

- a single rotary flap or a series of small rotary flaps (see FIG. 4),
- a single adjustable moving plate 7B, 8B of the guillotine type (not shown), etc

Advantages of the Device

The system according to the present invention offers the following advantages.

The gas flow rate in the first part or section of the cooler, called "primary" flow rate, can be regulated in order to monitor the solidifying front and solidification speed of the coating still in liquid phase at the inlet of the cooler, and therefore to obtain the best possible coating quality.

The internal regulating systems or equipment for the "primary" flow rate can be remotely controlled by the operator depending on a cooling quality/slope criterion. The "primary" blowing speed therefore continues to be monitored compared to a completely manual system. A pyrometer 17 or any other temperature measuring system, adapted to a moving strip, can be installed just after the regulating systems in order to monitor the cooling slope.

The second parts or sections of the two half-coolers 11, 12 can then have a "secondary" cooling flow rate that is significantly more substantial and compatible with the necessary cooling slopes, or with an increase in the cooling capacity of the cooler as a whole.

The cooling of the two half-coolers 11, 12 will therefore be adjusted and balanced between the speed variator 6 and the regulating systems 7, 8 delimiting the cooling inlet section. This gives the cooler a very considerable flexibility.

The regulating systems 7, 8 also allow optimal adjustment of the coating quality between the two faces of the strip 2, given that they will need to have the option of being controlled individually if necessary.

Due to the design of the system for monitoring the cooling of the two parts, the flow rate of the cooling fluid by surface unit is uniform in each of the sections, and in particular transversely.

Another advantage is the flexibility of the system: it will be very easy to move the regulating system to another position in the (pre-)cooler if the starting position is not or ceases to be appropriate. It is for example possible to provide three different positions of the regulating system.

LIST OF REFERENCES

1. Cooling box
2. Metal strip
3. Gas supply circuit
4. Fan
5. Motor
6. Motor speed variator
7. Internal regulating device
7A. Diffuser
7B. Adjustable moving plate
8. Internal regulating device
8A. Diffuser
8B. Adjustable moving plate
9. Actuator
10. Actuator
11. Half-cooler
12. Half-cooler
13. First section of the cooler
14. Second section of the cooler
15. Gas injection nozzles or slots
16. Third section of the cooler
17. Pyrometer

The invention claimed is:

1. Equipment for cooling a metal strip (2) having a liquid coating to be solidified, said metal strip being continuously moving, said equipment including a cooling box (1) provided with two gas half-coolers (11, 12), preferably using air, each designed to cool one face of the strip (2) and having each, on its inner face across from the respective face of the strip, a plurality of nozzles or slots (15) for injecting the gas at a certain flow rate, each half-cooler (11, 12) being divided over its length into at least two sections, a first section (13) and a second section (14), successively arranged in the direction of the movement of the strip (2), the first section (13) being separated from the second section (14) in each half-cooler (11, 12), transversally relative to the movement of the strip, by an internal regulating device (7, 8) able to modify the flow rate/pressure parameter in the first and second respective segments, the equipment being characterized in that the internal regulating devices (7, 8):

- either are diffusers comprising two superimposed plates each having a plurality of holes or slots and whereof the movement of one relative to the other results in modifying the opening section of the diffusers;
- or comprise a single rotary flap or a plurality of rotary flaps;
- or comprise an adjustable moving plate of the guillotine type, the half-coolers (11, 12) being connected to a shared supply circuit (3), supplied with gas by as single fan (4).

2. The equipment according to claim 1, characterized in that the internal regulating devices (7, 8) are actuated by pneumatic or electromechanical actuators (9, 10).

3. The equipment according to claim 2, characterized in that the actuators (9, 10) of the internal regulating devices (7, 8) are remotely controlled by a line operator.

4. The equipment according to claim 1, characterized in that the fan (4), is in turn, actuated by a motor (5).

5. The equipment according to claim 4, characterized in that the supply circuit (3) shared by the two half-coolers (11, 12) is connected to the second section (14) of at least one of the two half-coolers (11, 12) or to the section with a higher flow rate or higher pressure of gas.

6. The equipment according to claim 4, characterized in that the motor (5) is provided with a speed variator (6) making it possible to regulate the cooling gas flow rate/pressure parameter.

7. The equipment according to claim 6, characterized in that it comprises means for jointly or individually actuating the internal regulating devices (7, 8) as a function of the gas flow rate/pressure parameter regulated by the speed variator (6) and the desired coating quality.

8. The equipment according to claim 1, characterized in that the internal regulating devices (7, 8) are duplicated, thereby creating a third section, intermediate between the first inlet section of the strip and the second outlet section of the strip, in order to obtain different gas blowing speeds in the aforementioned three sections.

9. The equipment according to claim 1, characterized in that it is provided to move the strip in a vertical strand.

10. The equipment according to claim 1, characterized in that it includes a pyrometer installed after the internal regulating devices (7, 8) in the direction of the movement of the strip, to monitor the solidification of the coating.

11. A method for cooling a metal strip (2) moving continuously and having a liquid coating to be solidified, using the equipment according to claim 1, comprising a step for modifying the flow rate/pressure parameter of gas injected by means of internal regulating devices (7, 8) such that the value of said injected gas flow rate/pressure parameter is different in the first section (13) relative to its value in the second section (14).

12. The method according to claim 11, characterized in that the injected gas flow rate/pressure parameter is modified such that the value of said injected gas flow rate/pressure parameter is lower in the first section (13) compared to its value in the second section (14).

13. The method according to claim 11, characterized in that the gas flow rate injected in the first section of the cooling equipment, called primary flow rate, is regulated to control the solidifying front and solidification speed of the coating still in liquid phase at the inlet of the first section.

14. The method according to claim 11, characterized in that the injected gas flow rate in the second section of the cooling equipment, called secondary flow rate, is regulated to be higher than the primary flow rate and compatible with predetermined cooling slopes.

* * * * *